United States Patent [19]

Tsunoda

[11] Patent Number: 4,730,173

[45] Date of Patent: Mar. 8, 1988

[54] ASYMMETRICAL TRAP COMPRISING COAXIAL RESONATORS, REACTANCE ELEMENTS, AND TRANSMISSION LINE ELEMENTS

[75] Inventor: Kikuo Tsunoda, Nagaokakyo, Japan

[73] Assignee: Murata Manufacturing Co., Ltd., Nagaokakyo, Japan

[21] Appl. No.: 871,173

[22] Filed: Jun. 3, 1986

Related U.S. Application Data

[63] Continuation of Ser. No. 623,763, Jun. 20, 1984, abandoned.

[30] Foreign Application Priority Data

Jun. 23, 1983 [JP] Japan ..... 58-113892

[51] Int. Cl.[4] ..... H01P 1/202

[52] U.S. Cl. ..... 333/206; 333/222

[58] Field of Search ..... 333/202, 204, 206, 207, 333/222

[56] References Cited

U.S. PATENT DOCUMENTS

| | | | |
|---|---|---|---|
| 2,196,272 | 4/1940 | Peterson | 333/202 |
| 2,532,993 | 12/1950 | Carter | 333/206 X |
| 2,751,557 | 6/1956 | Sosin | 333/206 |
| 3,737,815 | 6/1973 | Low et al. | 333/202 X |
| 3,757,258 | 9/1973 | Dillman et al. | 333/206 |
| 4,245,198 | 1/1981 | Nishikawa et al. | 333/222 X |
| 4,342,972 | 8/1982 | Nishikawa et al. | 333/222 X |
| 4,382,238 | 5/1983 | Makimoto et al. | 333/206 X |
| 4,426,631 | 1/1984 | D'Avello et al. | 333/222 X |

FOREIGN PATENT DOCUMENTS

| | | | |
|---|---|---|---|
| 1541960 | 2/1967 | Fed. Rep. of Germany | 333/206 |
| 0081302 | 5/1983 | Japan | 333/202 |

OTHER PUBLICATIONS

"The Prevention of Interference by a Single Unwanted Frequency in TV Reception", *Electronic Engineering;* Jul. 1953, p. 298.

*Primary Examiner*—Eugene R. LaRoche
*Assistant Examiner*—Benny Lee
*Attorney, Agent, or Firm*—Wenderoth, Lind & Ponack

[57] ABSTRACT

An improved asymmetrical trap which includes at least one dielectric material coaxial resonator, a capacitor inserted between an inner conductor of the coaxial resonator and a first signal transmission line, with an outer conductor of the coaxial resonator being grounded so as to produce a series resonance at a first frequency through the combination of the capacitor and coaxial resonator, and a second transmission line connected, at their corresponding ends, in parallel with opposite ends of the series connection of the coaxial resonator and capacitor, and opened or short-circuited at their other far ends, so that anti-resonance is produced at a second frequency through the combination of the capacitor, coaxial resonator and second transmission line.

3 Claims, 15 Drawing Figures

ASYMMETRICAL TRAP COMPRISING COAXIAL RESONATORS, REACTANCE ELEMENTS, AND TRANSMISSION LINE ELEMENTS

This application is a continuation of now abandoned application Ser. No. 623,763 filed June 20, 1984.

BACKGROUND OF THE INVENTION

The present invention generally relates to an electrical trap and more particularly, to a so-called "asymmetrical trap" to be used, for example, in an ultra-high frequency (UHF) section of an electronic circuit to reject undesired frequencies.

Conventionally, there has been available an electrical trap adapted to attenuate a signal in a region of a specific frequency as shown by a solid line curve T in FIG. 1(*aa*) by producing a series resonance at such a specific frequency through the connection of a resonant line between a hot line (e.g. a line through which a signal is transmitted) and a cold line (e.g. a line which is grounded) of a signal transmission line. An electrical trap in which modes of attenuation at opposite side regions of a trap frequency $f_t$are similar to each other as shown by the solid line curve T in FIG. 1(*a*), is generally called a symmetrical trap. Meanwhile, as shown by a solid line curve T' in FIG. 2(*a*), an electrical trap in which modes of attenuation at opposite side regions of the trap frequency $f_t$ are different from each other due to presence of an anti-resonant frequency $f_p$ at a frequency region higher or lower than the trap frequency $f_t$, is sometimes referred to as an asymmetrical trap.

The anti-resonant frequency $f_p$ as described above may be utilized in the case where there is a frequency region which is not desired to be subjected to attenuation in the vicinity of the trap frequency $f_t$.

More specifically, for example, as shown in the frequency-attenuation diagram of FIG. 1(*a*), a dotted line characteristic curve F contains a spurious component as shown at Fs, and in such a case, the trap is combined with a band-pass filter in order to suppress such an undesirable spurious component. In the above case, the characteristics represented by the solid line curve T at a frequency region higher than the trap frequency $f_t$, vary in a gentle curve, thus adversely affecting the pass-band of the band-pass filter, and consequently, a dotted line characteristic curve F' of the band-pass filter is undesirably deviated from the center frequency $f_c$ as shown in FIG. 1(*b*). In order to eliminate the disadvantage as described above, it has been proposed to employ the asymmetrical trap in which the characteristics of the solid line curve T at the region higher than the trap frequency $f_t$vary sharply as shown by a solid line curve T' in FIG. 2(*a*). By the employment of the asymmetrical trap as described above, the undesirable spurious component may be advantageously suppressed without deviation of the characteristic curve of the band-pass filter as shown in FIG. 2(*b*).

Incidentally, in the conventional asymmetrical traps, the anti-resonant point $f_p$ as referred to above may be realized by connecting a reactance component in parallel with respect to the resonant line, and is displaced as shown by arrows m in FIG. 2(*a*) depending on values of the reactance component employed. In an electrical filter employing a re-entrant cavity resonator, it has been a common practice to set the anti-resonant point through alterations of a coupling method by changing configurations and positon of a probe at the coupling point thereof. However, electrical traps employing dielectric material coaxial resonators and capable of controlling the anti-resonant points thereof have not yet been put into actual application up to the present.

SUMMARY OF THE INVENTION

Accordingly, an essential object of the present invention is to provide an asymmetrical trap employing a dielectric material coaxial resonator and capable of controlling its anti-resonant frequency.

Another important object of the present invention is to provide an asymmetrical trap of the above described type which is compact in size and simple in construction and has a high reliability, and also to provide a band elimination filter having a plurality of stages and utilizing the compact asymmetrical traps of the above described type.

In accomplishing these and other objects, according to one preferred embodiment of the present invention, there is provided an asymmetrical trap which comprises at least one dielectric material coaxial resonator including a solid dielectric member provided between inner and outer conductors, a reactance element inserted between the inner conductor of the coaxial resonator and a first set of signal transmission lines, with said outer conductor of the coaxial resonator being grounded, so as to produce a series resonance at a first frequency through the combination of said reactance element and said coaxial resonator; a second set of transmission lines are connected, at corresponding ends thereof, in parallel with the opposite ends of the series connection of the coaxial resonator and the reactance element, and opened or short-circuited at the other far ends thereof, whereby anti-resonance is produced at a second frequency through the combination of said reactance element, said dielectric material coaxial resonator and said second set of transmission lines.

By the arrangement according to the present invention as described above, an improved asymmetrical trap has been advantageously presented, with substantial elimination of disadvantages inherent in the conventional asymmetrical traps of this kind.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 2A:
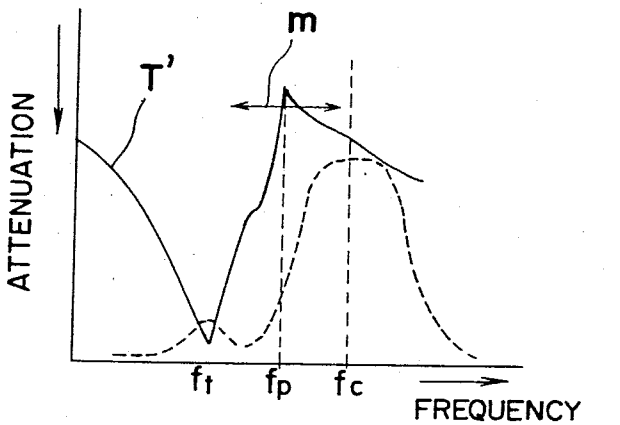
FIGS. 2(*a*) and 2(*b*) are also frequency-attenuation diagrams explanatory of characteristics curves for an asymmetrical trap to which the present invention may be applied (already referred to)
Figure 2B:
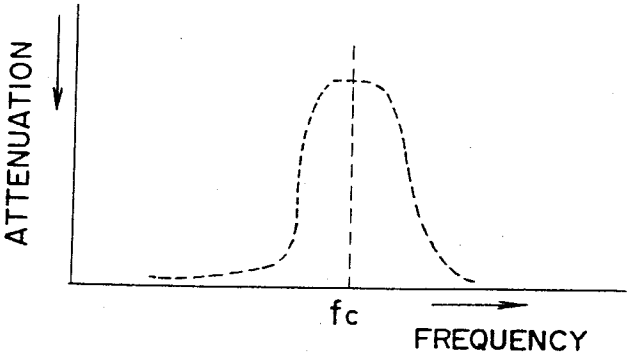
Figure 1A:
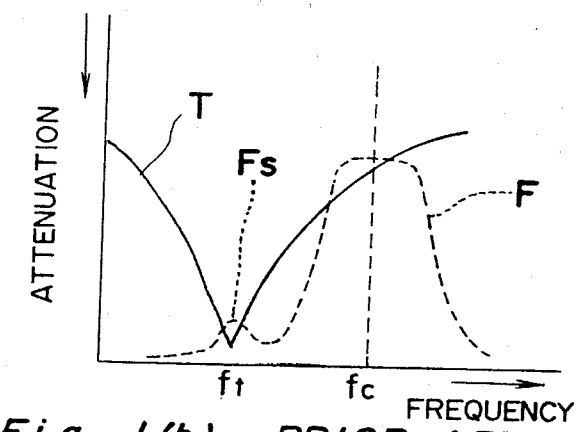
Fig. 1(a) PRIOR ART
FIGS. 1(*a*) and 1(*b*) are frequency-attenuation diagrams explanatory of characteristic curves for a conventional trap (already referred to)
Figure 1B:
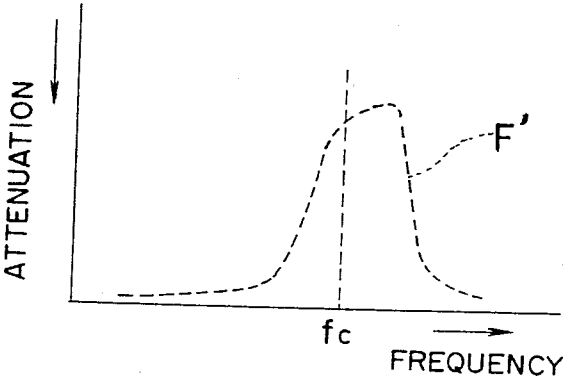
Fig. 1(b) PRIOR ART

Before the description of the present invention proceeds, it is to be noted that like parts are designated by like reference numerals throughout the accompanying drawings.

In the first place, referring to FIGS. 3(*a*) and 3(*b*), one example of a conventional electrical trap employing a dielectrical material coaxial resonator will be explained hereinbelow.

Figure 3A:
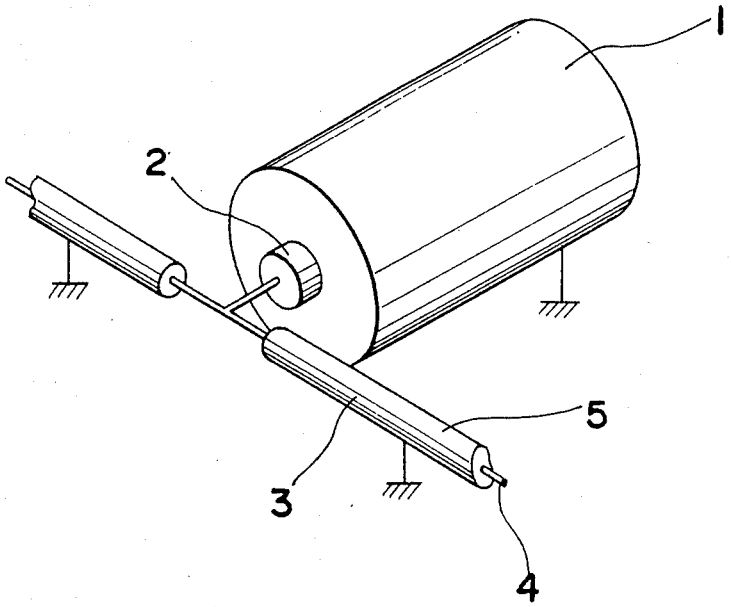
Fig. 3(a) PRIOR ART
FIGS. 3(*a*) and 3(*b*) are a perspective view and a schematic side sectional view of a conventional asymmetrical trap.
Figure 3B:
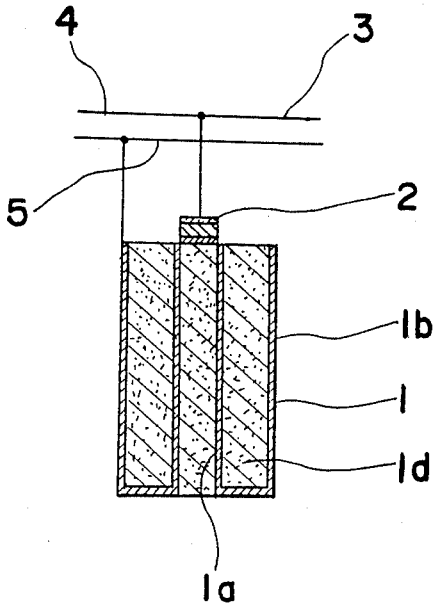
Fig. 3(b) PRIOR ART

The prior art trap shown in FIGS. 3(*a*) and 3(*b*) generally includes a dielectric material coaxial resonator 1 having a dielectric member 1*d* provided between an inner conductor 1*a* and an outer conductor 1*b*, a reactance element or capacitor 2 having a pair of electrodes provided on opposite faces of a dielectric member, and a signal transmission line 3 formed, for example, by a coaxial cable having a central conductor 4 and an outer conductor 5, with an insulator therebetween. According to a preferred embodiment, a semi-rigid cable is used for the coaxial cable 3. One electrode of the capacitor 2 is fixedly connected to the inner conductor 1*a* of the coaxial resonator 1, while the other electrode thereof is connected to the central conductor 4 of the signal transmission line 3, with the outer conductor 1*b* of the coaxial resonator 1 being connected to the outer covering conductor 5 of said signal transmission line 3. The signal transmission line 3 described as formed by the semi-rigid cable in the above example may be replaced by a strip line as will be understood from the embodiments according to the present invention given hereinbelow, in which like parts in FIGS. 3(*a*) and 3(*b*) are designated by like reference numeral for brevity of description.

Figure 4:
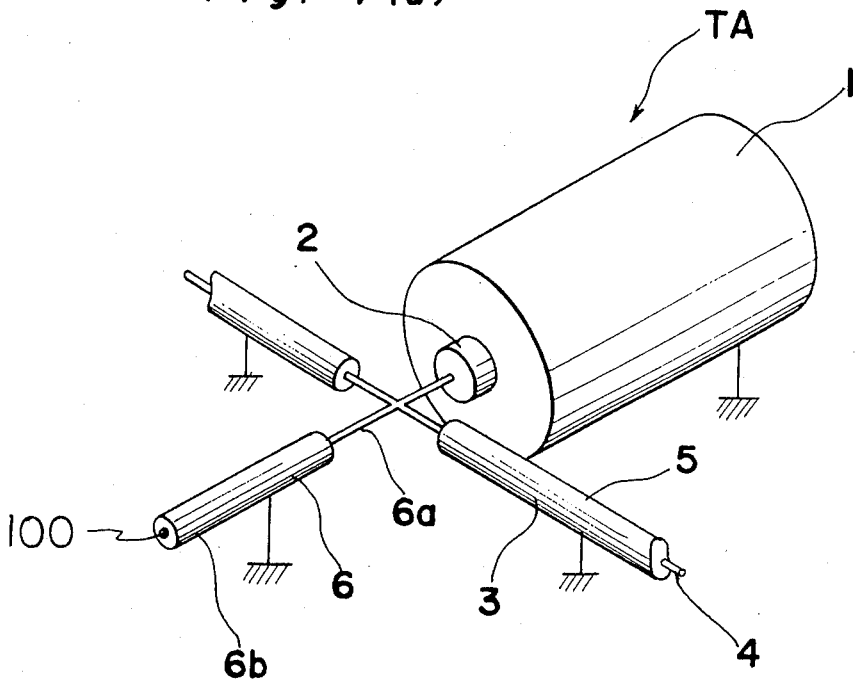
FIGS. 4(*a*) and 4(*b*) are a perspective view and a schematic side sectional view of an asymmetrical trap according to one preferred embodiment of the present invention.
Figure 4:
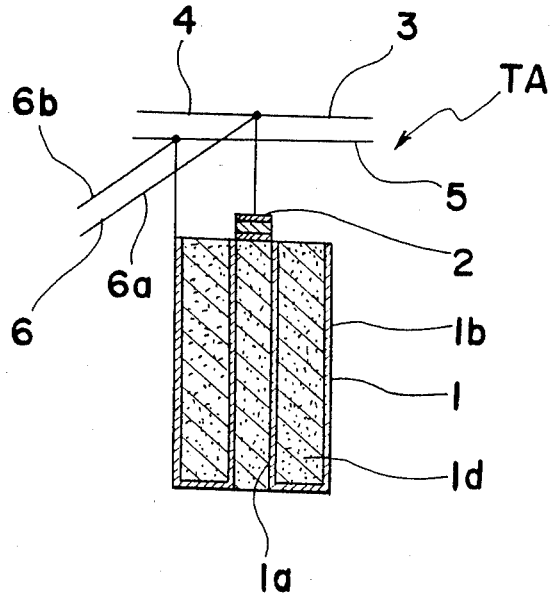

Referring now to FIGS. 4(*a*) and 4(*b*), there is shown an asymmetrical trap TA according to one preferred embodiment of the present invention, in which a transmission line which is open at its free end 100 as shown is formed, for example, by a semi-rigid cable 6, and the junction of the series connection circuit of the coaxial resonator 1 and the capacitor 2 is connected to a central conductor 6*a* of the cable 6 and an outer covering conductor 6*b* of the cable 6 is grounded, while other constructions are generally similar to those in the conventional trap of FIGS. 3(*a*) and 3(*b*). In the arrangement of FIGS. 4(*a*) and 4(*b*b) according to the present invention, since the semi-rigid cable 6 behaves in an inductive or capacitive manner depending on its length, its length is set so that the anti-resonance is produced at a predetermined frequency through the combination of the coaxial resonator 1, the capacitor 2 and the semi-rigid cable 6.

Figure 5:
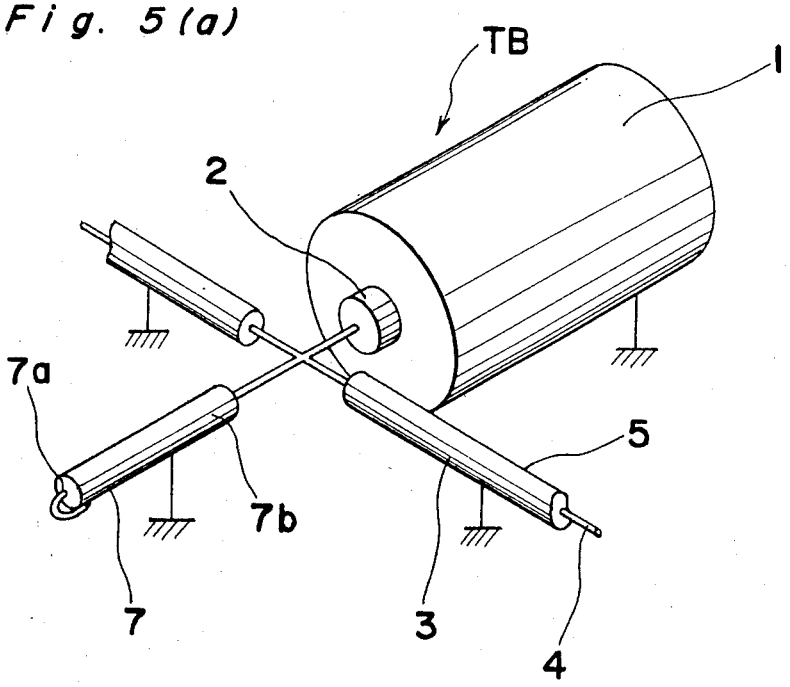
FIGS. 5(*a*) and 5(*b*) are views similar to FIGS. 4(*a*) and 4(*b*), which particularly show another embodiment thereof.
Figure 5:
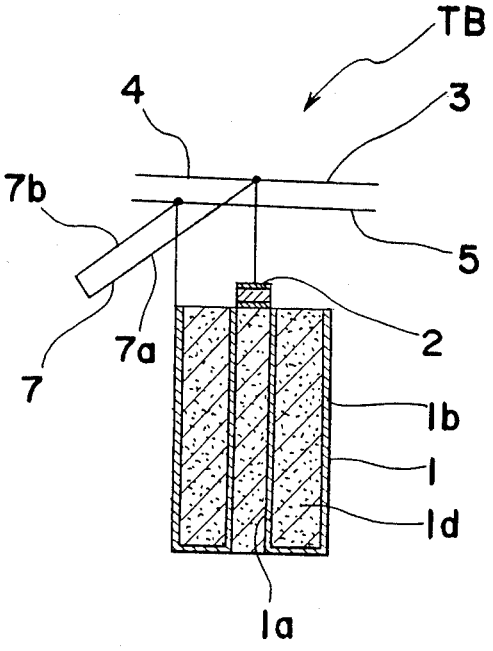

Meanwhile, in an asymmetrical trap TB according to another embodiment of the present invention shown in FIGS. 5(*a*) and 5(*b*), the semi-rigid cable 6 for the transmission lines which is open at its free end as employed in the trap TA of FIGS. 4(*a*) and 4(*b*) is replaced by a semi-rigid cable 7 for the transmission line which is short-circuited or closed at its free end, with the junction of the series connection circuit of the coaxial resonator 1 and the capacitor 2 being connected to the central conductor 7*a* of the cable 7 and the outer covering conductor 7*b* of the cable 7 being grounded, although other constructions and functions of the trap TB are generally similar to those in the trap TA of FIGS. 4(*a*) and 4(*b*), with like parts being designated by like reference numerals.

Figure 6A:
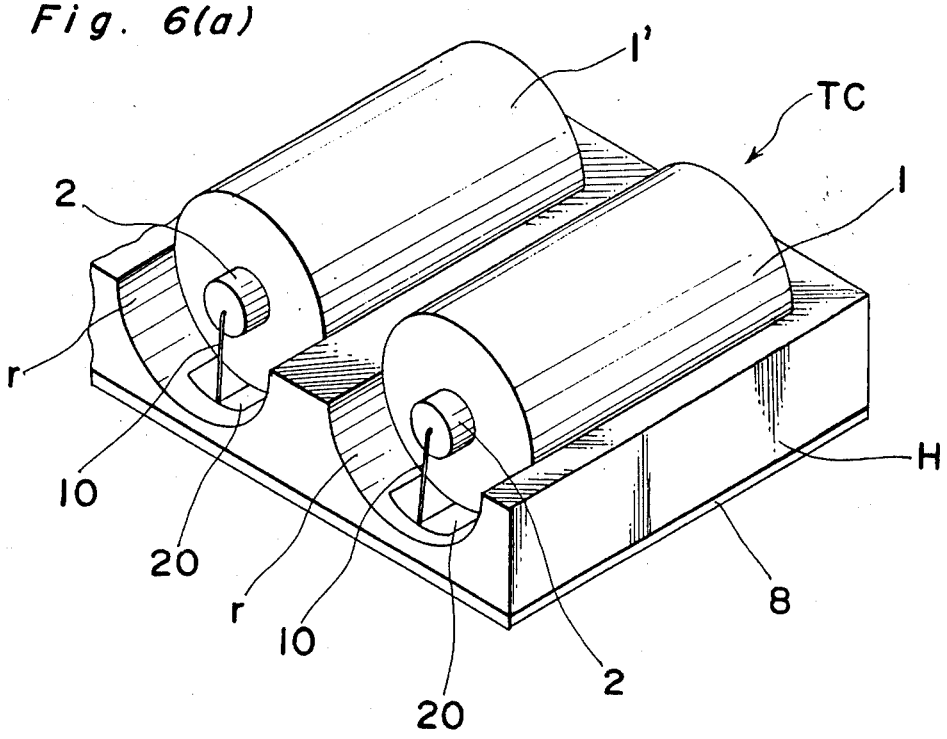
FIGS. 6(*a*), 6(*b*) and 6(*c*) are a fragmentary perspective view, a fragmentary bottom plan view and a crosssectional view of asymmetrical traps according to a further embodiment of the present invention.
Figure 6B:
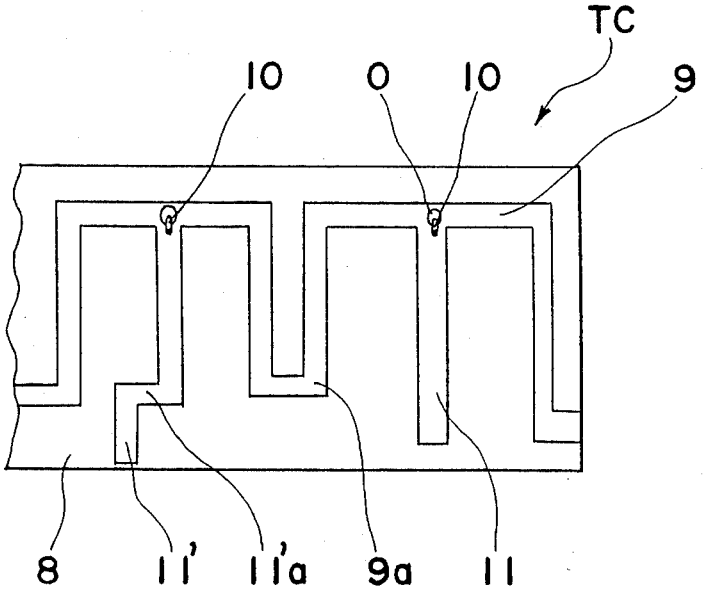
Figure 6:
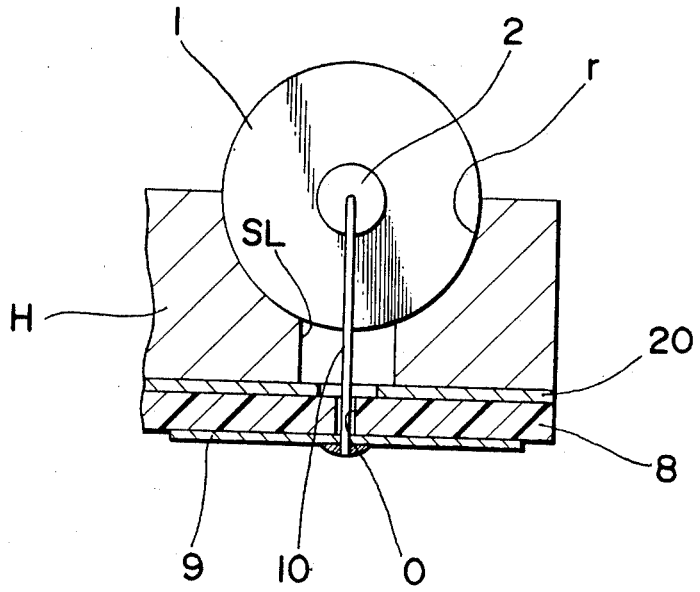

Reference is further made to FIGS. 6(*a*), 6(*b*) and 6(*c*) showing a plurality of asymmetrical traps TC according to a further embodiment of the present invention.

In the traps TC, the transmission lines 3, having a central conductor 4 and outer conductor 5 as employed in the traps TA and TB in FIGS. 4(*a*) to 5(*b*) are replaced by a connecting strip 9 and a ground electrode 20, respectively, while the semi-rigid cable 6 or 7, having central conductors 6*a* or 7*a* and outer covering conductors 6*b* or 7*b* are replaced by a strip line central conductor 11 or 11' and ground electrode 20, respectively. The strip line central conductor 11 or 11' extends in a direction at right angles with the connecting strip 9.

More specifically, in the arrangement of FIGS. 6(*a*) to 6(*c*), a plurality of coaxial resonators 1 and 1' and so forth are accommodated in corresponding recesses r formed in a case H made of a metallic material. A substrate of an insulating material 8 is fixedly provided on a bottom surface of the case H. As best shown in FIG. 6(*c*), a through opening SL in a shape of slit is formed at the bottom of each recess. The substrate 8 has a ground electrode 20 deposited on its one surface and conductor lines 9, 11 and 11', as best shown in FIG. 6(*b*), deposited on the other surface. The ground electrode 20 is tightly held in contact with the case H and, therefore, outer conductor 1*b* of the resonator 1 is connected through the case H to the ground electrode 20. A lead wire 10 extending from the resonance element 2 is inserted through an opening O formed in the substrate 8 and is connected to the connecting strip 9. To prevent the wire 10 from touching ground electrode 20, a part of ground electrode 20 around the opening O is removed. As shown in FIG. 6(*b*), the strip line central conductors 11, 11' and so on for controlling the anti-resonant point, extend in a direction at right angles from connecting strip 9, thus providing a plurality of asymmetrical traps TC (only two of them are illustrated in FIGS. 6(*a*)). The connecting strip 9 has a portion 9*a* folded in a U-shaped so as to reduce a connecting distance with respect to a neighboring coaxial resonator 1' for a compact size of the trap on the whole, while the strip line central conductor 11' also has a portion 11'*a* folded in an L-shape to provide a predetermined length to the central conductor 11'.

Figure 7A:
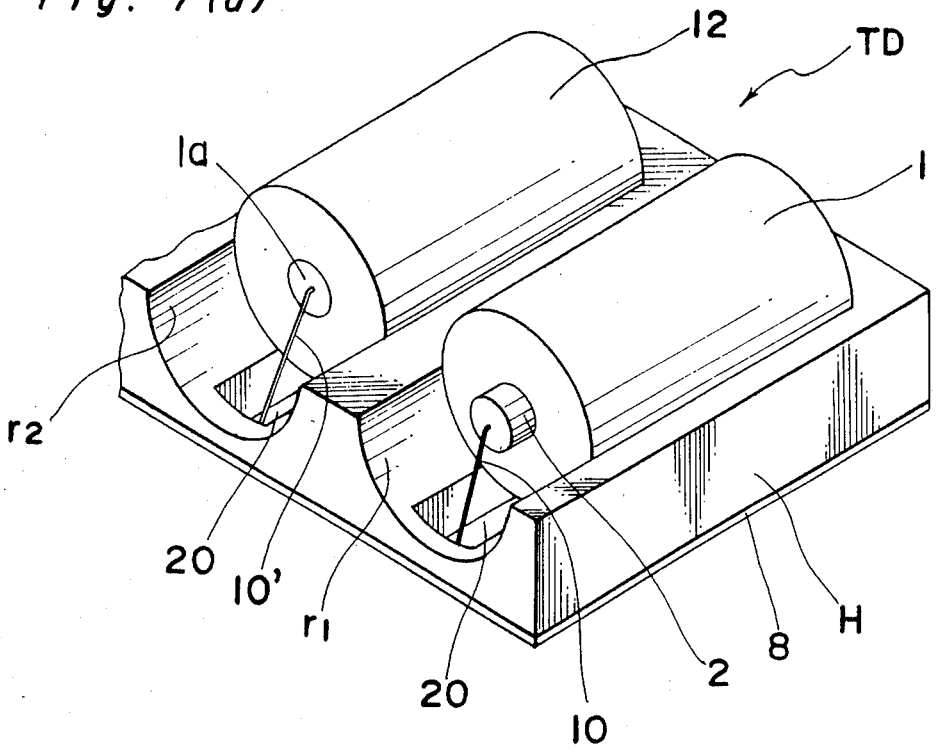
FIGS. 7(*a*) and 7(*b*) are views similar to FIGS. 6(*a*) and 6(*b*), which particularly show a still further embodiment thereof.
Figure 7B:
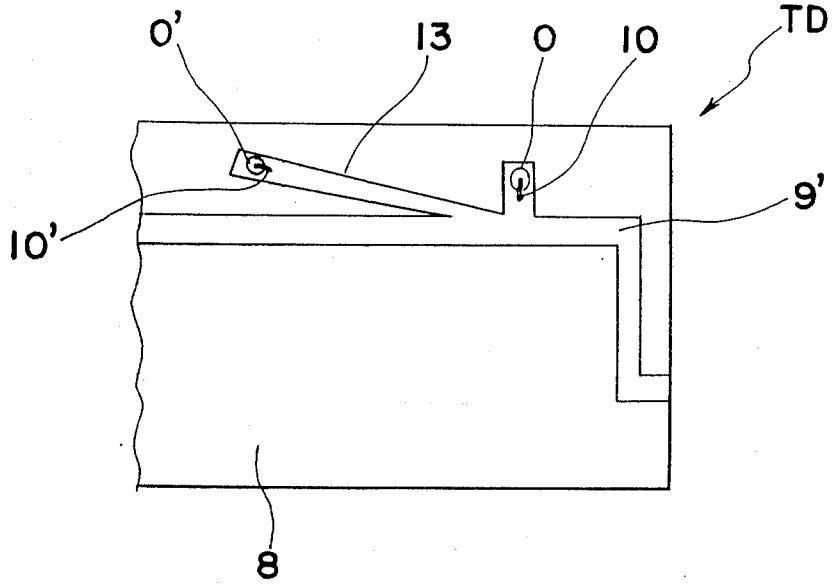

Referring further to FIGS. 7(*a* ) and 7(*b*), there is shown an asymmetrical trap TD according to a still further embodiment of the present invention.

In FIGS. 7(*a*) and 7(*b*, the coaxial resonator 1 and another coaxial resonator 12 are respectively accommodated in corresponding recesses r1 and r2 formed in a casing H. In this embodiment, coaxial resonator 12 has the inner conductor which is directly connected to lead wire 10'. Thus, coaxial resonator 12 functions as the central conductor 11 or 11' in FIG. 6(*b*). The lead wires 10 and 10' respectively extend through openings O and O' in a similar manner to that shown in FIG. 6(*c*). As shown in FIG. 7(*b*), the lead wire 10 is connected to connecting strip 9', and the lead wire 10 is connected through a line 13 to the strip 9'. The line 13 extends straight from a portion of the strip 9' where the lead wire 10 is connected.

In the above arrangement of FIGS. 7(*a*) and 7(*b*), the coaxial resonators 1 and 12 constitute one set of asymmetrical trap TD.

It should be noted here that, in the foregoing embodiments, although the series resonance is adapted to take place when the coaxial resonator functions as an equivalent inductance, it may be so modified that the capacitor 2 is replaced by electrical elements capable of functioning as an inductance such as a coil, lead wire, strip line central conductor or the like so that the series resonance takes place when the coaxial resonator functions as an equivalent capacitance.

As is clear from the foregoing description, according to the present invention, it becomes possible to properly control the anti-resonant frequency, with the trap being maintained to be compact in size through employment of the dielectric material coaxial resonator, and also to manufacture asymmetrical traps in a plurality of stages and band elimination filters utilizing such asymmetrical traps.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. An asymmetrical trap which comprises a plurality of dielectric material coaxial resonators, each of said resonators including a solid dielectric member provided between inner and outer conductors, at least one reactance element inserted between the inner conductor of a respective one of said plurality of coaxial resonators and an ungrounded conductor of a first signal transmission line, said first signal transmission line having said ungrounded conductor and another conductor, said outer conductor of said respective one of said plurality of coaxial resonators and said another conductor of said first signal transmission line being grounded so as to thereby produce a series resonance at a first frequency through the combination of said respective reactance element and said respective one of said plurality of coaxial resonators, and a second transmission line having one ungrounded conductor and having another conductor which is grounded, said second transmission line having one end of said ungrounded conductor connected to the connection junction between said ungrounded conductor of said first signal transmission line and said respective reactance element, said second transmission line having a selected length and having another end of said ungrounded conductor terminated such that anti-resonance is produced at a second frequency through the combination of said respective reactance element, said respective one of said plurality of coaxial resonators and said second transmission line;

wherein said first transmission line comprises a connection strip having a portion folded into a U-shaped and wherein said ungrounded conductor of said first transmission line has a portion folded into an L-shape of a predetermined length and wherein said second tranmission line is connected to said respective one of said plurality of coaxial resonators.

2. An asymmetrical trap as recited in claim 1, wherein said second transmission line comprises at least one dielectric material coaxial resonator and at least one line which connects a center conductor of said at least one coaxial resonator with said connection strip of said first signal transmission line.

3. An asymmetrical trap as recited in claim 1, wherein said at least one reactance element comprises a capacitor.

* * * * *